US006234231B1

(12) United States Patent
Boss et al.

(10) Patent No.: US 6,234,231 B1
(45) Date of Patent: May 22, 2001

(54) DEVICE FOR ATTACHING A SUPPLEMENT TO A SURFACE OF SIGNATURES

(75) Inventors: Christian Boss, Zofingen; Ernst Luethi, Brittnau, both of (CH)

(73) Assignee: Grapha-Holding AG, Hergiswil (CH)

( * ) Notice: Subject to any disclaimer, the term of this patent is extended or adjusted under 35 U.S.C. 154(b) by 0 days.

(21) Appl. No.: 09/199,565

(22) Filed: Nov. 25, 1998

(30) Foreign Application Priority Data

Nov. 25, 1997 (EP) ..... 97810905

(51) Int. Cl.[7] ..... B65C 9/00; B65C 9/12

(52) U.S. Cl. ..... 156/556; 156/564; 156/567; 156/569; 156/570

(58) Field of Search ..... 156/555, 556, 156/557, 564, 566, 567, 568, 569, 570, 571

(56) References Cited

U.S. PATENT DOCUMENTS

| | | | | |
|---|---|---|---|---|
| 3,826,706 | * | 7/1974 | Muller | 156/566 |
| 4,293,365 | * | 10/1981 | Geyser et al. | 156/364 |
| 4,457,801 | * | 7/1984 | Zodrow | 156/364 |
| 4,605,459 | * | 8/1986 | Voltmer et al. | 156/215 |
| 5,425,837 | * | 6/1995 | Hansch | 156/556 |
| 5,658,422 | * | 8/1997 | Boss et al. | 156/556 |

FOREIGN PATENT DOCUMENTS

| | | | |
|---|---|---|---|
| 684589 | * | 10/1994 | (CH) . |
| 22 28231 C3 | | 2/1973 | (DE) . |
| 0 570 339 A1 | | 11/1993 | (EP) . |
| 0 776771 A1 | | 6/1997 | (EP) . |
| WO 83 04221 | | 12/1983 | (WO) . |

* cited by examiner

*Primary Examiner*—Richard Crispino
*Assistant Examiner*—Sue A. Purvis
(74) *Attorney, Agent, or Firm*—Venable; Robert Kinberg; Catherine M. Voorhees

(57) ABSTRACT

A device for attaching a supplement to an exposed surface of signatures transported one after another in a transporting direction along a guide arrangement includes a rotating gripping roller for picking up the supplements at the circumference of the rotating gripping roller with a controlled gripping tool. The rotating gripping roller has a rotational axis arranged approximately at a right angle to the transporting direction and at least approximately parallel to the exposed surface of the transported signatures. An adhesive feeder is provided along a transporting path for supplements. A forward feed is operatively arranged with the rotating gripping roller to operate in cycle with the rotating gripping roller for placing the supplements approximately tangentially with respect to the rotating gripping roller so that the supplements are on the circulation path for the controlled gripping tool.

14 Claims, 2 Drawing Sheets

DEVICE FOR ATTACHING A SUPPLEMENT TO A SURFACE OF SIGNATURES

CROSS-REFERENCE TO RELATED APPLICATIONS

Priority is claimed with respect to European application No. 97810905.6 filed Nov. 25, 1997, in the European Patent Office, the disclosure of which is incorporated herein by reference.

BACKGROUND OF THE INVENTION

The invention relates to a device for attaching a supplement to an exposed surface of signatures, which are transported one after another on a guide arrangement. Such a device includes a rotating gripping roller for picking up the supplements at the circumference by means of a controlled gripping tool. The rotating gripping roller has a rotational axis arranged approximately at a right angle to the transporting direction and at least approximately parallel to the exposed surface of the transported signatures. The device furthermore comprises an adhesive feeding device provided along the path for transporting the supplements.

German patent document DE-C-22 28 231 discloses a device of the type described above which is used with a gathering and wire-stitching machine. With this device, signatures are deposited on a saddle-shaped guide arrangement such that they straddle it and are conveyed along.

Such a device is also suitable for the processing of signatures into glued-together, thread-stitched or side-stitched book blocks. Prior to the binding of the book back, the signatures are deposited one above the other in a collection channel supplied by signature feeders, or in a gathering machine and are then conveyed further. In this procedure, the supplements are attached during transport toward the collection channel or inside the latter.

Increasingly, hard items are used as supplements. Such hard items, which include, among other things, CD's or product samples that are suitable as supplements for publications because of their flat shape, cannot be supplied with the known devices. Owing to their stiffness, they require a different processing method from that of flexible items.

SUMMARY OF THE INVENTION

It is an object of the invention to create a device of the aforementioned type which permits the unrestricted processing of flat and stiff items as supplements.

The above and other objects are accomplished according to the invention by the provision of a device for attaching a supplement to an exposed surface of signatures transported one after another in a transporting direction along a guide arrangement, including: a rotating gripping roller, having a circumference and including a controlled gripping tool having a circulation path, for picking up the supplements at the circumference of the rotating gripping roller with the controlled gripping tool, the rotating gripping roller having a rotational axis arranged approximately at a right angle to the transporting direction and at least approximately parallel to the exposed surface of the transported signatures; an adhesive feeder, provided along a transporting path for the supplements; and a forward feed operatively arranged with the rotating gripping roller to operate in cycle with the rotating gripping roller for placing the supplements approximately tangentially with respect to the rotating gripping roller so that the supplements are on the circulation path for the controlled gripping tool.

The solution according to the invention thus provides a synchronously operating forward feed to the gripping roller which is used to push the supplements approximately tangentially toward the circular path of an opened gripping tool which is driven in the same direction. This solution offers a reliable, automatic processing of flat, stiff items as supplements, the use of proven individual parts, as well as the option of selectively supplying either hard or soft items.

It is advantageous if the supplements in this case are arranged such that they are stacked approximately perpendicular to the pushing movement, so that little space is required for providing them and they are in a favorable position for removal.

If the items are provided with the aid of a stacking hopper, a sliding plate is advantageously used to supply the gripping roller, which sliding plate fits flush against the underside of the supplement stack, can be moved back and forth, and holds the respectively lowest supplement in the stack.

The rear edge of the sliding plate can be designed to have a carrier for gripping the deposited supplement in a form-fitting manner, but which is adjusted to be less high than the supplement, so that the carrier can move without interruption when pushing a supplement underneath the following supplement or the one positioned above it. During the return movement of the sliding plate, the following supplement initially rests on the carrier, that is until the carrier has assumed the starting position in which the supplement is deposited on the sliding plate.

Alternatively, the sliding plate facing the supplement stack can be provided with openings connected to a vacuum source, wherein during the feeding movement of the sliding plate, a negative pressure is generated with controlled valves between the sliding plate and the supplement resting thereon. A pressure is generated in between after the supplement is transferred.

The back and forth movement of the sliding plate can be achieved simply by using a crank mechanism and connecting rod.

It makes sense if the supplements are attached to the signatures by a feeding device that is connected downstream of the gripping roller, takes over the supplements from the latter and attaches them to the signatures.

According to one embodiment, the feeding device comprises a driven belt guide that picks up the supplements at the gripping roller and a contact pressure roller which is drive-connected to the belt guide and faces the signatures passing by.

The belt guide is preferably formed by a segment of two endlessly circulating belts, fitting flush against each other between the gripping roller and the contact pressure roller so that a straight transfer segment is created to ensure an exact attachment of the supplements to the signatures.

The belt guide is arranged such that it is displaced to the side of the circular path for the gripping tool for the purpose of a trouble-free acceptance of the supplements by the gripping tool, wherein a belt guide is preferably provided on both sides of the circular path for the gripping tool.

The release of the supplements to the belt guide/belt guides can be made easier if a belt forming the belt guide at the circular path for the gripping tool is drive-connected with the gripping roller on the one hand and the contact pressure roller on the other hand.

It is possible to achieve a uniform operational sequence for attaching the supplements to the signatures by having a belt guide that ends downstream at the contact pressure roller.

The device for applying adhesive (glue) to the supplements is preferably arranged in front of the belt guide, as seen in the transporting direction of the supplements, where the supplement is always in a stable position. The adhesive can be applied either through direct or indirect contact of the supplement with the adhesive feeding device.

The device according to the invention can be combined to form one unit with a known feeder system to allow for an optional processing of hard or stiff supplements or flexible (soft) supplements.

It is preferable if a feeder for flexible supplements is arranged at the circular path for the gripping tools, displaced counter-clockwise relative to the forward feed for stiff supplements according to the above described invention. This feeder is provided with a separating device, connected such that it operates in the same cycle as the gripping roller for the device, for removing the individual supplements from the stack underside. That is to say, while the above described forward feed according to the invention for separating stiff supplements is turned off, the feeder for flexible supplements can be switched on to run synchronously with the gripping roller.

BRIEF DESCRIPTION OF THE DRAWINGS

The invention is explained below with the aid of two exemplary embodiments and by referring to the following drawings, to which reference is made with respect to all details not further mentioned in the description.

DETAILED DESCRIPTION OF THE INVENTION

Figure 1:
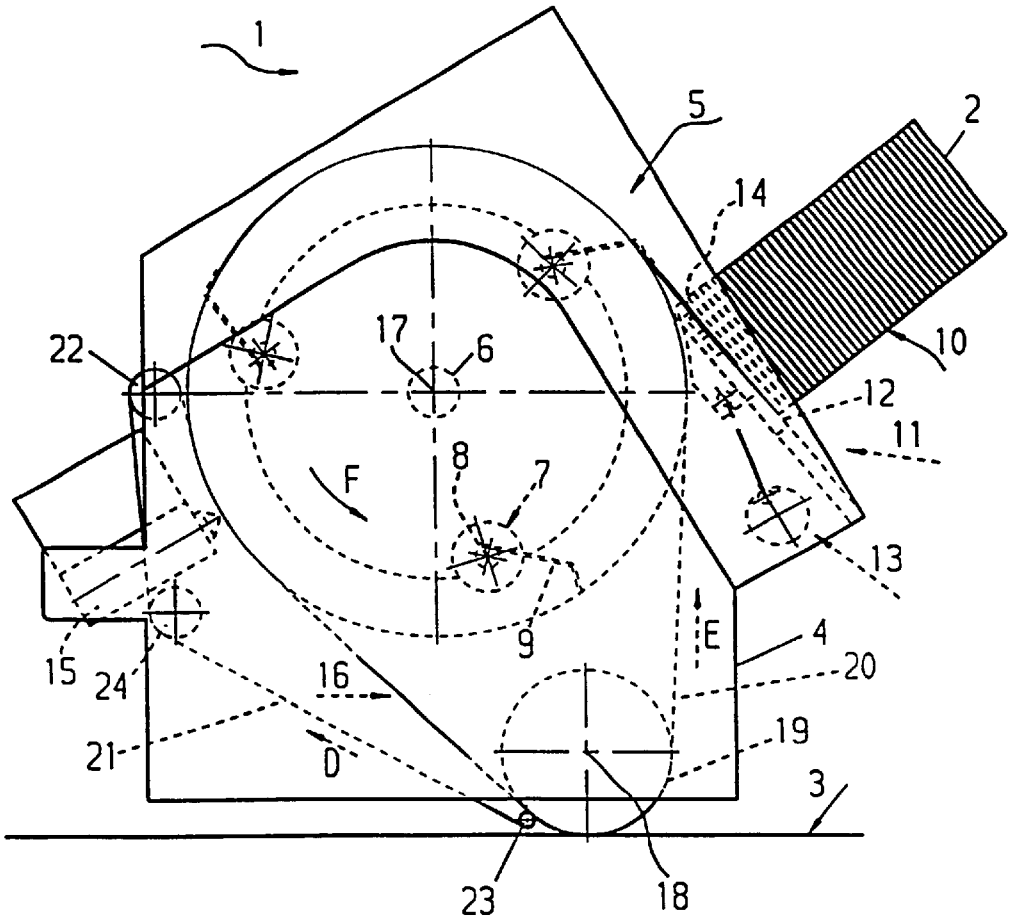
FIG. 1 is a schematic side view of a device according to the invention.

FIG. 1 illustrates a device 1 for attaching a supplement 2 to an exposed surface of signatures (not shown), which are transported one after another along a guide arrangement 3. The side view of device 1 is perpendicular to one of the support planes for the signatures, which are positioned on a saddle-shaped collecting segment of a gathering and wire-stitching machine. Device 1 has a frame 4 connected to the gathering and wire-stitching machine. A rotating gripping roller 5 is positioned on this frame by means of a motor-driven shaft 6 and parallel to the support plane for guide arrangement 3. The illustrated gripping roller 5 has three gripping tools 7, distributed over the circumference, the opening and closing of which is mechanically controlled according to their functions during rotation around rotational axis 17 of gripping roller 5. Control processes of this type are known and are therefore not further described herein.

The illustrated gripping tools 7 are each provided with two gripper arms 9 that are attached to a control shaft. If gripping tool 7 is closed, the ends of these gripper arms, which are bent at an angle, cooperate with the surface of gripping roller 5 and hold a supplement 2 until it is to be transferred.

A hopper 10 for stacking supplements 2 is also attached to frame 4. The respectively lowest supplement is moved by a forward feed 11 to gripping roller 5. The back and forth movement occurs via a mechanically or pneumatically driven sliding plate 12, which picks up the lowest supplement 2 in the stack and pushes it in a tangential connection to gripping roller 5 toward an open gripping tool 7. The gripper arms 9 of the open gripping tool 7 in this case have moved past the pick-up location before the supplement 2 arrives there. Owing to a shaft 8 that is rotatably driven by a spring or an operating cam, gripper arms 9 jump back to the closed position, thereby gripping the front edge of supplement 2 at the circumference of gripping roller 5. Following this, a crank mechanism 13 pulls sliding plate 12 back to the starting position, where it comes to rest once more against the lowest supplement. Sliding plate 12 and supplement 2 are fixedly connected through openings 14 in sliding plate 12, which on the one hand face supplement 2 and on the other hand are connected to a vacuum source via a control valve (not visible). If a vacuum is generated, the lowest supplement 2 adheres to sliding plate 12, which is driven in the same cycle as the rotating gripping tools 7 and essentially in the same direction as these when in the transfer position. This operational sequence is continuous, so that supplement 2 subsequently assumes a stable position. Following this, the path of supplement 2 passes by an adhesive feeder 15, which applies the adhesive to supplement 2 while it moves past. The embodiment shown provides an injection device for applying the liquid adhesive.

During the continued path, the supplement 2 leaves the gripping roller 5 and is then clamped in by a belt guide 16 in a region not coated with adhesive. This belt guide 16 connects the circumference of gripping roller 5 to a contact pressure roller 19 that rotates around a parallel axis 18 and fits flexibly against the adjacent support plane for guide arrangement 3, so that signatures with varied thicknesses can pass through between guide arrangement 3 and contact pressure roller 19.

Belt guide 16, or the transport segment between gripping roller 5 and contact pressure roller 19, is formed by two endless belts 20, 21, respectively, rotating around several axes, which fit against each other back to back in the region of belt guide 16. Both belts 20, 21 run at the same speed. In order to provide a favorable guidance of supplements 2, respectively two each of these belts are placed across the width of gripping roller 5, at a distance from the side. One of the pairs of circulating belts 20 is attached to the circumference of gripping roller 5, such that on the one hand it approximately follows the circular path of gripping tools 7, while on the other hand, it is deflected once more at contact pressure roller 19 that is arranged at a distance. The belts 20 of a pair in this case can be displaced to the side, meaning below or to the outside of gripping tools 7. In order to avoid a slipping effect, at least this pair of belts 20 is form-fittingly drive-connected to the gripping roller 5, e.g. with the aid of toothed belts. The oppositely positioned pair of belts 21, located on the segment for belt guide 16, is preferably driven synchronously around three pairs of deflection rollers 22, 23, 24. Of these, the deflection rollers 22 form a continuous connection to the circular path of supplements 2 at gripping tools 7 and form belt guide 16 together with the pair of deflection rollers 23. Deflection rollers 23 in this case have a relatively small diameter, so that supplements 2 can be pulled as close as possible to the gap-type transition location between guide arrangement 3 and contact pressure roller 19. The third pair of deflection rollers 24 serves to ensure an economical arrangement and design of the belts 21.

The arrow F in FIG. 1 represents the rotational direction of gripping roller 5 while the arrows D and E refer to the circulation direction of belt pairs 20, 21.

Figure 2:
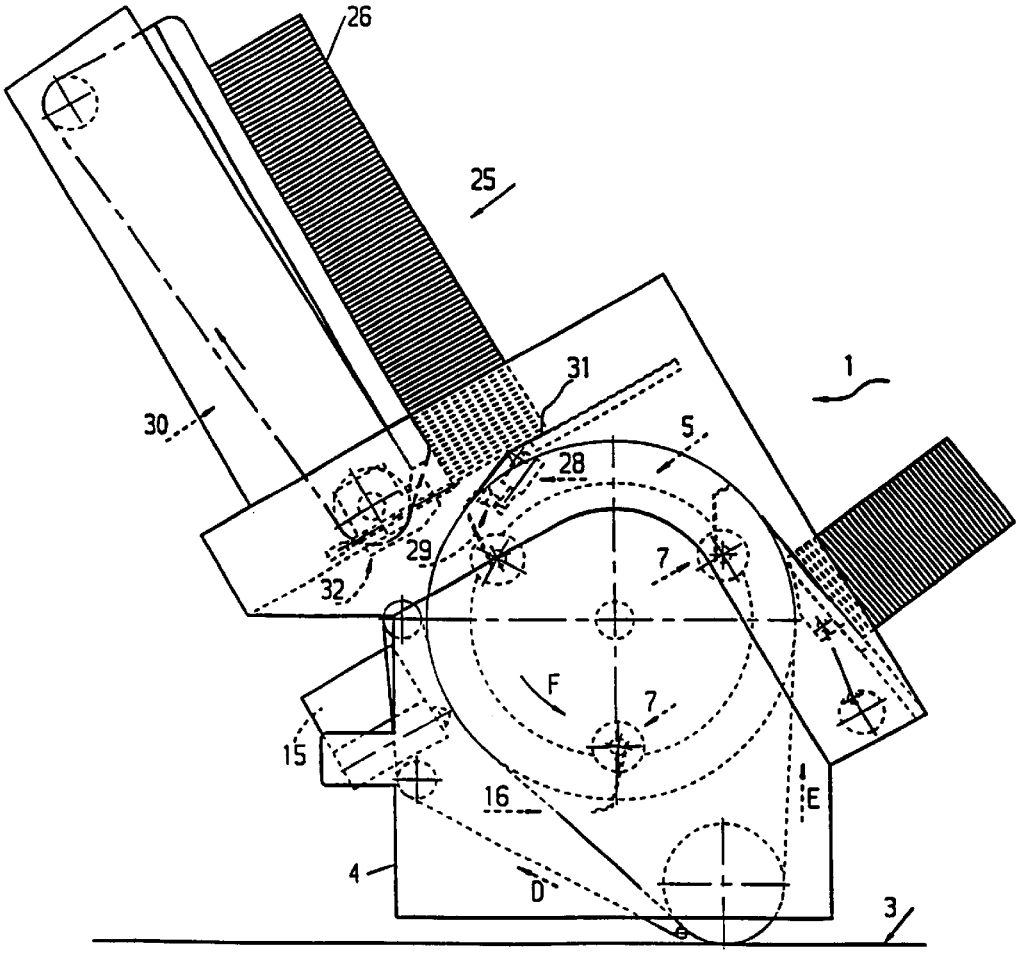
FIG. 2 is schematic side view of a device according to the invention, combined with a known feeder for flexible supplements.

In FIG. 2, device 1 according to FIG. 1 is combined with a feeder 25, known as a signature feeder. This design is not suitable for separating stiff supplements 2 from a stack. A modification of the solution according to the invention makes it possible to combine the existing infrastructure with a feeder 25 for flexible supplements. That is to say, an additional separating device 28 is arranged on existing frame 4, along the circular path for the gripping tools 7, which additional separating device ensures that the respectively lowest supplement 26 in the stack is removed so that it can be gripped by one of circulating gripping tools 7, wherein the supplement that has been pushed forward is gripped in the same way as described above.

Among other things, separating device 28 comprises a suction head 29, attached to a pivoting arm, which is connected to a vacuum source (not visible) and is controlled so as to operate in cycle with the circulating gripping tools 7.

FIG. 2 furthermore shows a device 30 for levelling out supplement stack 26, which device exerts an alignment effect counter to the stack-formation direction by acting upon the edges of supplements 26. Continuously circulating belts, for example, are suitable for this.

The stack of supplements 26 rests on a plate 31 and on a retaining device 32, which is added from cycle to cycle and which leaves the support position briefly, just before a supplement 26 is picked up by the assigned suction head 29, so as to release the lowest supplement 26 for removal by the suction head 29. The supplements 26, processed by feeder 25, are sprayed uniformly with an adhesive by the adhesive feeding device 15 and are subsequently attached to the signatures on guide arrangement 3.

The invention has been described in detail with respect to preferred embodiments, and it will now be apparent from the foregoing to those skilled in the art, the changes and modifications may be made without departing from the invention in its broader aspects, and the invention, therefore, as defined in the appended claims, is intended to cover all such changes and modifications as to fall within the true spirit of the invention.

What is claimed is:

1. A device for attaching a supplement to an exposed surface of signatures which are transported one after another in a transporting direction along a guide arrangement, said device comprising:

a rotating gripping roller, having a circumference and including a controlled gripping tool having a circulation path, for picking up the supplements at the circumference of the rotating gripping roller with the controlled gripping tool, the rotating gripping roller having a rotational axis arranged approximately at a right angle to the transporting direction and at least approximately parallel to the exposed surface of the transported signatures;

an adhesive feeder, provided along a transporting path for supplements;

a forward feed operatively arranged with the rotating gripping roller to operate in cycle with the rotating gripping roller for placing the supplements approximately tangentially with respect to the rotating gripping roller so that the supplements are on the circulation path of the controlled gripping tool; and means for attaching a supplement to an exposed surface of a signature.

2. The device according to claim 1, further including a hopper arranged for forming a stack of supplements approximately perpendicular to the rotational axis of the rotating gripping roller.

3. The device according to claim 2, wherein the forward feed includes a sliding plate that fits against a bottom of the supplement stack in the hopper.

4. A device according to claim 3, wherein the sliding plate includes a side facing the supplement stack that includes openings connectable to a vacuum source.

5. The device according claim 4, wherein the feed forward includes a crank mechanisms drive-connected to the sliding plate.

6. The device according to claim 2, wherein the forward feed is dis-engageable and the device further comprises an additional feed operable with the rotating gripping roller and including an additional hopper for holding a further stack of supplements and a further separating device for removing supplements from the underside of the further stack.

7. The device according to claim 6, wherein the further separating device includes a pivoting arm and a suction head attached to the pivoting arm that can be brought in communication with a vacuum source.

8. The device according to claim 1, wherein said means for attaching a supplement to an exposed surface of a signature includes a feeding device operatively coupled downstream of the rotating gripper roller for taking over the supplements from the rotating gripper roller and supplying them to the guide arrangement so that the supplements adhere to the signatures.

9. The device according to claim 8, wherein the feeding device comprises a driven belt guide that picks up the supplements at the rotating gripping roller and a contact pressure roller drive connected to the belt guide.

10. The device according to claim 9, wherein the belt guide comprises a segment of two endlessly circulating belts which are arranged flush against each other between the rotating gripping roller and the contact pressure roller.

11. The device according to claim 10, wherein the two endlessly circulating belts are displaced to a side of the circular path for the rotating gripping tool.

12. The device according to claim 11, wherein one of the two endlessly circulating belts which form the belt guide is drive-connected to the rotating gripping roller and the contact pressure roller.

13. The device according to claim 9, wherein the belt guide terminates downstream at the contact pressure roller.

14. The device according to claim 9, wherein the adhesive feeder is arranged in front of the belt guide as seen in the transport direction of supplements.

* * * * *